US010916194B2

(12) United States Patent
Yang et al.

(10) Patent No.: US 10,916,194 B2
(45) Date of Patent: Feb. 9, 2021

(54) PIXEL COMPENSATION DEVICE AND METHOD, PIXEL DRIVING DEVICE, TIMING CONTROL MODULE AND DISPLAY APPARATUS

(71) Applicant: BOE Technology Group Co., Ltd., Beijing (CN)

(72) Inventors: Fei Yang, Beijing (CN); Yue Wu, Beijing (CN); Dongxu Han, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/117,134

(22) Filed: Aug. 30, 2018

(65) Prior Publication Data

US 2019/0156753 A1 May 23, 2019

(30) Foreign Application Priority Data

Nov. 17, 2017 (CN) ..... 2017 1 1142279

(51) Int. Cl.
*G09G 3/3258* (2016.01)
*G09G 3/3266* (2016.01)
*G09G 3/3233* (2016.01)

(52) U.S. Cl.
CPC ..... *G09G 3/3258* (2013.01); *G09G 3/3233* (2013.01); *G09G 3/3266* (2013.01); *G09G 2310/08* (2013.01); *G09G 2320/0233* (2013.01); *G09G 2320/0295* (2013.01); *G09G 2320/0626* (2013.01); *G09G 2330/021* (2013.01); *G09G 2330/028* (2013.01); *G09G 2360/16* (2013.01)

(58) Field of Classification Search
CPC ... G09G 3/3258; G09G 3/3233; G09G 3/3266
See application file for complete search history.

(56) References Cited

U.S. PATENT DOCUMENTS

2015/0154910 A1* 6/2015 Okuno ..... G09G 3/3258 345/212
2017/0025061 A1* 1/2017 Takizawa ..... G09G 3/3233
2017/0116922 A1* 4/2017 Jung ..... G09G 3/3258

* cited by examiner

*Primary Examiner* — Alexander Eisen
*Assistant Examiner* — Cory A Almeida
(74) *Attorney, Agent, or Firm* — Nath, Goldberg & Meyer; Joshua B. Goldberg

(57) ABSTRACT

The present application provides a pixel compensation device, a pixel compensation method, a pixel driving device, a timing control module and a display apparatus. The pixel compensation device includes a luminance conversion unit, an emitting voltage calculation unit, an emitting voltage offset calculation unit and a data conversion unit. The data conversion unit is configured to read pre-stored emitting voltage offset compensation data for a driving transistor in a sub-pixel unit with respect to a gate-source voltage of the driving transistor and obtain corresponding first luminance compensation data based on the emitting voltage offset and the emitting voltage offset compensation data. The data conversion unit is further configured to generate source luminance data based on the luminance signal data and the first luminance compensation data and output the source luminance data to a source driving module.

19 Claims, 6 Drawing Sheets

PIXEL COMPENSATION DEVICE AND METHOD, PIXEL DRIVING DEVICE, TIMING CONTROL MODULE AND DISPLAY APPARATUS

CROSS-REFERENCE TO RELATED APPLICATION

This application claims priority to Chinese Patent Application No. 201711142279.7, filed on Nov. 17, 2017, the entire contents of which are hereby incorporated by reference.

TECHNICAL FIELD

The present disclosure relates to the field of display technology and information processing technology, and particularly, to a pixel compensation device, a pixel compensation method, a pixel driving device, a timing control module and a display apparatus.

BACKGROUND

Compared to the conventional display technologies, the organic light emitting diode (OLED) display has many advantages such as wider viewing angle, higher brightness, higher contrast, lower power consumption and smaller physical thickness. In the OLED display apparatus, a pixel driving circuit is configured to drive each OLED associated with each sub-pixel in the display panel to emit light. The pixel driving circuit includes a driving transistor connected with the OLED, and a driving current is generated through the driving transistor to flow through the OLED, thereby driving the OLED to emit light. When the driving transistor is in a saturation state, a change of the source-drain voltage of the driving transistor will slightly change the driving current flowing through the driving transistor, thereby slightly changing the brightness of the OLED, which in turn lowers image display quality.

SUMMARY

In an aspect, the present disclosure provides a pixel compensation device, which includes: a luminance conversion unit configured to receive color data for a sub-pixel unit and convert the colordata into corresponding luminance signal data; an emitting voltage calculation unit configured to calculate preset emitting voltage data for the sub-pixel unit based on the luminance signal data; an emitting voltage offset calculation unit configured to receive the preset emitting voltage data, compare the preset emitting voltage data with a reference value of an anode voltage and/or a reference value of a cathode voltage for the sub-pixel unit to generate an emitting voltage offset; and a data conversion unit configured to read pre-stored emitting voltage offset compensation data for a driving transistor in the sub-pixel unit with respect to a gate-source voltage of the driving transistor and obtain corresponding first luminance compensation data based on the emitting voltage offset and the emitting voltage offset compensation data. The data conversion unit is further configured to generate source luminance data based on the luminance signal data and the first luminance compensation data and output the source luminance data to a source driving module.

In some embodiments, the pixel compensation device further includes an algorithm compensation unit configured to receive the luminance signal data and monitoring data fed back from the source driving module and calculate compensated luminance data. The emitting voltage calculation unit includes a compensation calculation sub-unit configured to calculate the preset emitting voltage data for the sub-pixel unit based on the compensated luminance data and transmit the preset emitting voltage data to the emitting voltage offset calculation unit. The data conversion unit includes a compensation conversion sub-unit configured to obtain corresponding second luminance compensation data based on the emitting voltage offset and the emitting voltage offset compensation data, and generate the source luminance data based on the compensated luminance data and the second luminance compensation data.

In some embodiments, the emitting voltage calculation unit includes: a maximum luminance calculation unit configured to calculate a maximum luminance value of the sub-pixel unit based on the luminance signal data and output the maximum luminance value to an emitting voltage setting unit; and the emitting voltage setting unit configured to receive the maximum luminance value of the sub-pixel unit, generate the preset emitting voltage data for the sub-pixel unit, and output the preset emitting voltage data to the emitting voltage offset calculation unit.

The present disclosure further provides a timing control module, which includes any one of the pixel compensation devices described herein.

In some embodiments, the timing control module further includes a timing conversion unit configured to receive a timing control signal and generate a source control signal and a gate control signal.

The present disclosure further provides a pixel driving device, which includes any one of the timing control module described herein.

In some embodiments, the pixel driving device further includes: a data storage module configured to pre-store a plurality of groups of emitting voltage offset compensation data for driving transistors with respect to different gate-source voltages to be read by the data conversion unit; a source driving module configured to receive the source luminance data and the source control signal and generate a source driving voltage for the sub-pixel unit; a gate driving module configured to receive the gate control signal and generate a gate driving voltage for the sub-pixel unit; and a emitting voltage setting module configured to receive the preset emitting voltage data and generate the anode voltage and/or the cathode voltage for the light emitting element of the sub-pixel unit.

In some embodiments, the data storage module is configured to pre-store one or more of: characteristic values of different driving transistors, characteristic values of different light emitting elements and optical compensation characteristic values of different light emitting elements.

In some embodiments, the pixel driving device further includes a sensing and monitoring module configured to detect sensing and monitoring data that is fed back from the sub-pixel unit and output the sensing and monitoring data to the timing control module through the source driving module.

In some embodiments, the sub-pixel unit includes a driving transistor, a switching transistor and at least one light emitting element. A cathode of the light emitting element is applied with a cathode voltage, and an anode of the light emitting element is coupled with a source of the driving transistor. A drain of the driving transistor is applied with an anode voltage for the light emitting element, and a gate of the driving transistor is coupled with a drain of the switching transistor. A gate of the switching transistor is coupled with a first scan line, and a source of the switching transistor is coupled with a data line. A storage capacitor is connected between the drain of the switching transistor and the source of the driving transistor.

In some embodiments, the sub-pixel unit further includes a sensing transistor. A drain of the sensing transistor is coupled with a sensing line, a source of the sensing transistor is coupled with the source of the driving transistor, and a gate of the sensing transistor is coupled with a second scan line.

The present disclosure further provides a display apparatus, which includes any one of the pixel driving devices described herein.

The present disclosure further provides a sub-pixel circuit, which includes a driving transistor, a switching transistor and at least one light emitting element. A cathode of the light emitting element is applied with a cathode voltage, and an anode of the light emitting element is coupled with a source of the driving transistor. A drain of the driving transistor is applied with an anode voltage for the light emitting element, and a gate of the driving transistor is coupled with a drain of the switching transistor. A gate of the switching transistor is coupled with a first scan line, and a source of the switching transistor is coupled with a data line. A storage capacitor is connected between the drain of the switching transistor and the source of the driving transistor.

In some embodiments, the sub-pixel circuit further includes a sensing and monitoring module configured to detect sensing and monitoring data for the light emitting element, and feed back the sensing and monitoring data to the timing control module.

In some embodiments, the sensing and monitoring module of the sub-pixel circuit includes a sensing transistor. A source of the sensing transistor is coupled with the source of the driving transistor, a gate of the sensing transistor is coupled with a second scan line, and a drain of the sensing transistor is coupled with a sensing line, so as to output the sensing and monitoring data to the timing control module.

The preset disclosure further provides an array substrate, which includes a base substrate and a sub-pixel circuit on the base substrate. The sub-pixel circuit is any one of the sub-pixel circuits described herein.

The present disclosure further provides a display apparatus, which includes the array substrate described herein.

The present disclosure further provides a pixel compensation method. The method includes: reading pre-stored emitting voltage offset compensation data for a driving transistor in a sub-pixel unit with respect to a gate-source voltage of the driving transistor; receiving color data for the sub-pixel unit and converting the color data into corresponding luminance signal data; calculating preset emitting voltage data for the sub-pixel unit based on the luminance signal data; comparing the preset emitting voltage data with a reference value of an anode voltage and/or a reference value of a cathode voltage for the sub-pixel unit to generate an emitting voltage offset; obtaining corresponding first luminance compensation data based on the emitting voltage offset and the emitting voltage offset compensation data; and generating source luminance data based on the luminance signal data and the first luminance compensation data and outputting the source luminance data to a source driving module.

In some embodiments, after converting the color data into the corresponding luminance signal data, the method further includes: calculating compensated luminance data based on the luminance signal data and monitoring data fed back from the source driving module; calculating preset emitting voltage data for the sub-pixel unit based on the luminance signal data includes: calculating the preset emitting voltage data for the sub-pixel unit based on the compensated luminance data; obtaining the first luminance compensation data based on the emitting voltage offset and the emitting voltage offset compensation data; and generating the source luminance data based on the luminance signal data and the first luminance compensation data includes: obtaining second luminance compensation data based on the emitting voltage offset and the emitting voltage offset compensation data, and generating the source luminance data based on the compensated luminance data and the second luminance compensation data.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Figure 1:
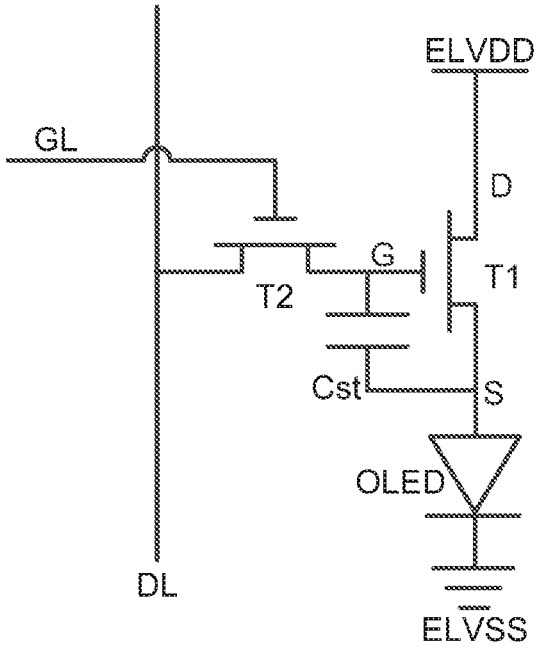
FIG. 1 is a structural schematic diagram illustrating an OLED sub-pixel circuit according to an embodiment of the present disclosure.
Figure 2A:
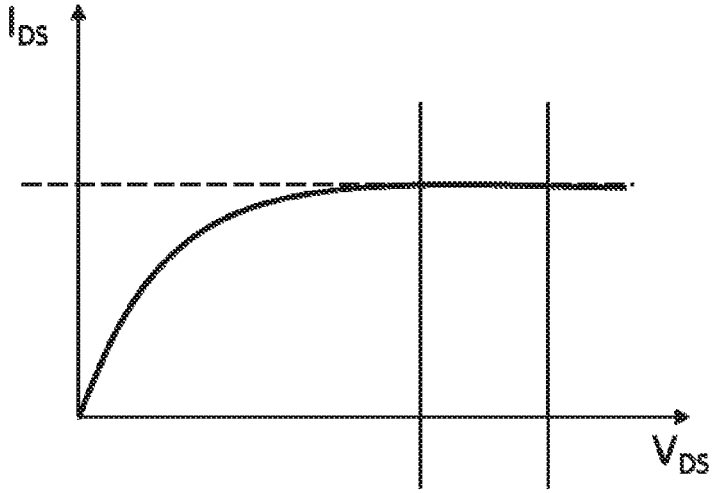
FIG. 2A is an $I_{DS}$-$V_{DS}$ curve of a driving transistor in a sub-pixel circuit in an ideal case.
Figure 2B:
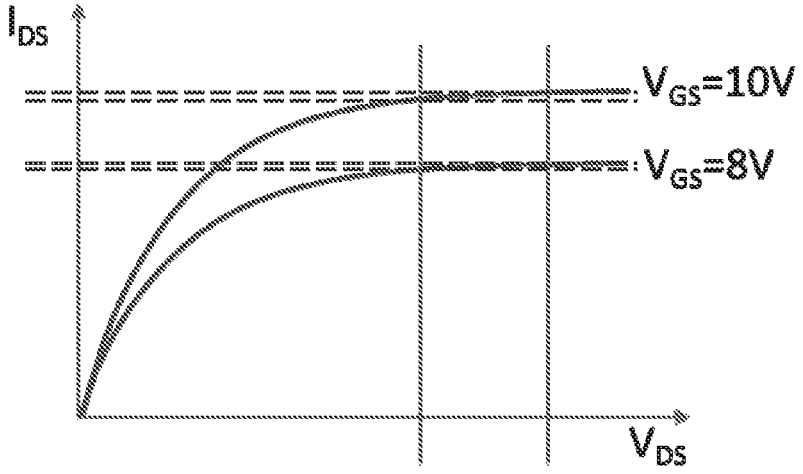
FIG. 2B illustrates exemplary $I_{DS}$-$V_{DS}$ curves of the driving transistor in the sub-pixel circuit with respect to two different values of $V_{GS}$ in a practical case.

In OLED display apparatuses, a current flowing through a driving transistor may be controlled by a gate voltage of the driving transistor. FIG. 1 is a schematic diagram illustrating a basic structure of an OLED sub-pixel circuit in the present disclosure. As illustrated in FIG. 1, the OLED sub-pixel circuit may be a conventional ( )ED sub-pixel circuit and mainly includes a driving transistor T1, a switching transistor T2, a storage capacitor Cst and a light emitting element (e.g., OLED). With respect to a certain voltage $V_{GS}$ (i.e., a difference in voltage between the gate and the source of the driving transistor) of the driving transistor T1, a change of a voltage $V_{DS}$ (i.e., a difference in voltage between the drain and the source of the driving transistor) of the driving transistor may affect an current $I_{DS}$ (i.e., the current from the drain of the driving transistor to the source thereof) flowing through the driving transistor. FIG. 2A is an $I_{DS}$-$V_{DS}$ curve of the driving transistor in the sub-pixel circuit in an ideal case. As illustrated in FIG. 2A, in a case where the driving transistor T1 is in a saturation state, the voltage $V_{DS}$ may be changed by lowering the anode voltage (i.e., ELVDD in FIG. 1) for the light emitting element or by lowering the cathode voltage (i.e., ELVSS in FIG. 1) for the light emitting element, to lower electroluminescence (EL) consumption without changing the current flowing through the driving transistor T1. FIG. 2B illustrates exemplary $I_{DS}$-$V_{DS}$ curves of the driving transistor in the sub-pixel circuit with respect to two different values of $V_{GS}$ in a practical case. In the practical case, when the driving transistor T1 is in a saturation state, the EL consumption may be lowered by lowering the anode or cathode voltage for the light emitting element, but the change of the voltage $V_{DS}$ may slightly change the current flowing through the driving transistor T1, thereby slightly changing the brightness of the light emitting element and lowering image display quality.

Accordingly, the present disclosure provides, inter alia, a pixel compensation device, a pixel compensation method, a pixel driving device, a timing control module and a display apparatus that substantially obviate one or more of the problems due to limitations and disadvantages of the related art.

Figure 3:
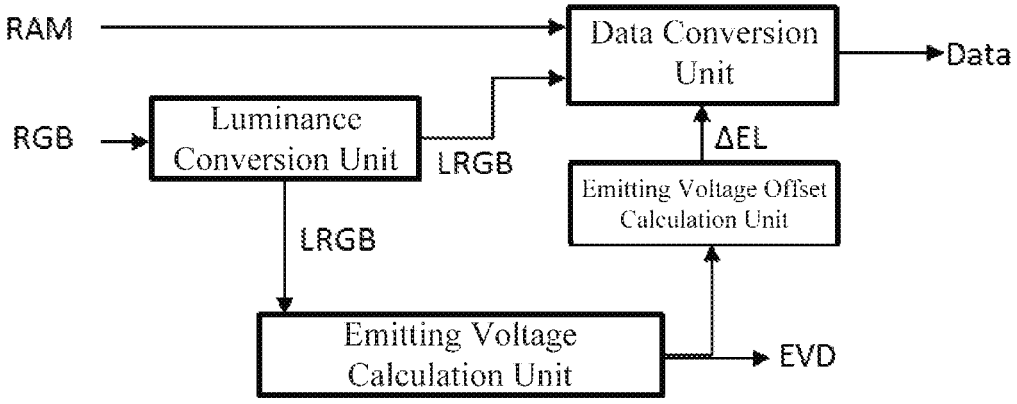
FIG. 3 is a structural schematic diagram illustrating a pixel compensation device according to an embodiment of the present disclosure.

FIG. 3 is a structural schematic diagram illustrating modules of a pixel compensation device according to an embodiment of the present disclosure. As illustrated in FIG. 3, the pixel compensation device in some embodiments of the present disclosure includes: a luminance conversion unit configured to receive color data RGB for a sub-pixel unit, convert the color data RGB into corresponding luminance signal data LRGB, and output the luminance signal data LRGB to an emitting voltage calculation unit and a data conversion unit; the emitting voltage calculation unit configured to calculate preset emitting voltage data (EVD) for the sub-pixel unit based on the luminance signal data LRGB and output the preset emitting voltage data EVD to an emitting voltage offset calculation unit; the emitting voltage offset calculation unit configured to receive the preset emitting voltage data EVD, compare the preset emitting voltage data EVD with a reference value of an anode voltage and/or a reference value of a cathode voltage for the sub-pixel unit to generate an emitting voltage offset ΔEL, and output the emitting voltage offset ΔEL to the data conversion unit; and the data conversion unit configured to read pre-stored emitting voltage offset compensation data for a corresponding driving transistor with respect to a corresponding gate-source voltage $V_{GS}$ and obtain corresponding first luminance compensation data based on the emitting voltage offset ΔEL and the emitting voltage offset compensation data. The data conversion unit is further configured to generate source luminance data Data based on the luminance signal data LRGB and the first luminance compensation data and output the source luminance data Data to a source driving module.

Here, the gate-source voltage $V_{GS}$ refers to a difference between the gate voltage and the source voltage of the driving transistor; the emitting voltage offset compensation data refers to differences for compensating circuit parameters of respective elements other than the light emitting element to keep the brightness of the light emitting element unchanged in a case where the voltage difference $V_{DS}$ between the drain voltage and the source voltage of the driving transistor is changed under a certain voltage $V_{GS}$. In the basic structure of the sub-pixel circuit as illustrated in FIG. 1, the luminance signal data LRGB is input to the gate of the driving transistor T1 and controls the voltage at the anode of the OLED through the storage capacitor Cst. As such, a certain value of LRGB corresponds to a certain value of $V_{GS}$; and $I_{DS}$-$V_{DS}$ curves of the driving transistor T1 with respect to different values of $V_{GS}$ can be derived by measurements, as illustrated in FIG. 2B. Therefore, the certain value of LRGB will correspond to a determined $I_{DS}$-$V_{DS}$ curve. In the present disclosure, the emitting voltage calculation unit may determine the preset emitting voltage data EVD, which may includes values of the anode voltage ELVDD and/or the cathode voltage ELVSS, based on a maximum luminance signal data. According to the structure and principle of the above-mentioned circuit, the values of $V_{GS}$ and $V_{DS}$ of the driving transistor T1 can be determined when the luminance signal data LRGB is determined, and then a corresponding preset value of $I_{DS}$ can be derived from the $I_{DS}$-$V_{DS}$ curve of the driving transistor T1. In a similar way, a reference value of $I_{DS}$ can be obtained for a reference value of the anode voltage ELVDD and/or a reference value of the cathode voltage ELVSS, and the difference $\Delta I_{DS}$ between the preset value of $I_{DS}$ and the reference value of $I_{DS}$ corresponds to the emitting voltage offset ΔEL. When the color data RGB is changed, the value of LRGB is changed correspondingly, such that the value of $V_{GS}$ is also changed, and the $I_{DS}$-$V_{DS}$ curve is changed, as illustrated in FIG. 2B. Data such as values of LRGB and corresponding values of $V_{GS}$, numerical relationship of the $I_{DS}$-$V_{DS}$ curve with respect to each value of $V_{GS}$, values of $\Delta I_{DS}$ corresponding to the emitting voltage offsets ΔEL and the like, can be stored in a data storage module in advance to be read and used by the data conversion unit. The reference value of the anode voltage ELVDD and the reference value of the cathode voltage ELVSS may be preset default values in the related art.

When the pixel compensation device provided by the present disclosure is used in a pixel circuit, the data conversion unit converts the received color data RGB into luminance signal data LRGB and transmits the luminance signal data LRGB to the emitting voltage calculation unit; the emitting voltage calculation unit determines the preset emitting voltage data EVD and transmits the preset emitting voltage data EVD to the emitting voltage offset calculation unit; the emitting voltage offset calculation unit compares the preset emitting voltage data EVD with a reference value of the anode voltage ELVDD or a reference value of the cathode voltage ELVDD to obtain an emitting voltage offset ΔEL. In a case where ΔEL is a negative value (e.g., an actual value of the anode voltage ELVDD is smaller than the reference value of the anode voltage ELVDD), the data conversion unit reads pre-stored emitting voltage offset compensation data for a corresponding driving transistor (i.e., T1 in FIG. 1) with respect to a corresponding gate-source voltage, finds the emitting voltage offset compensation data corresponding to the emitting voltage offset ΔEL, and obtains corresponding first luminance compensation data based on the emitting voltage offset ΔEL and the emitting voltage offset compensation data. Taking FIGS. 1 and 2B as an example, with respect to various data voltages of different sub-pixels (corresponding to determined values of $V_{GS}$), $I_{DS}$-$V_{DS}$ curves are different, and the compensation values of currents are different (i.e., $\Delta I_{DS}$ are different); in a case where the emitting voltage offset ΔEL is a negative value, $\Delta I_{DS}$ is also a negative value, such that $I_{DS}$ decreases as the anode voltage ELVDD decreases, the current flowing through the driving transistor decreases to lower the brightness of the OLED. In this case, the source luminance data Data needs to be increased, that is, the first luminance compensation data ΔData is a positive value, the value of the first luminance compensation data ΔData may be determined in consideration of the driving current I flowing through the light emitting element OLED, and $I=K*(V_{GS}-Vth)^2$, where K is mobility of the driving transistor, and Vth is the threshold voltage of the driving transistor; then, the source luminance data Data can be generated based on the luminance signal data LRGB and the first luminance compensation data. The preset emitting voltage data EVD may correspond to a relatively low anode voltage or a relatively low cathode voltage to achieve the effect of saving power consumption; the reduction of brightness of the light emitting element due to the reduction of the anode voltage ELVDD or cathode voltage ELVSS can be compensated for by the source luminance data. Data, such that the purpose of keeping the brightness of the light emitting element unchanged and saving power consumption can be achieved.

After generating the preset emitting voltage data for the sub-pixel unit, the pixel compensation device provided by the present disclosure further compares the preset emitting voltage data with the reference value of the anode voltage and/or the reference value of the cathode voltage to obtain the emitting voltage offset, obtains corresponding first luminance compensation data based on the emitting voltage offset and the emitting voltage offset compensation data read by the data conversion unit, and generates the source luminance data based on the color data received by the luminance conversion unit and the first luminance compensation data, such that the display brightness of the light emitting element keeps unchanged while the power consumption of the light emitting element is lowered by decreasing the driving voltage of the light emitting element, thereby improving image display quality.

Figure 4:
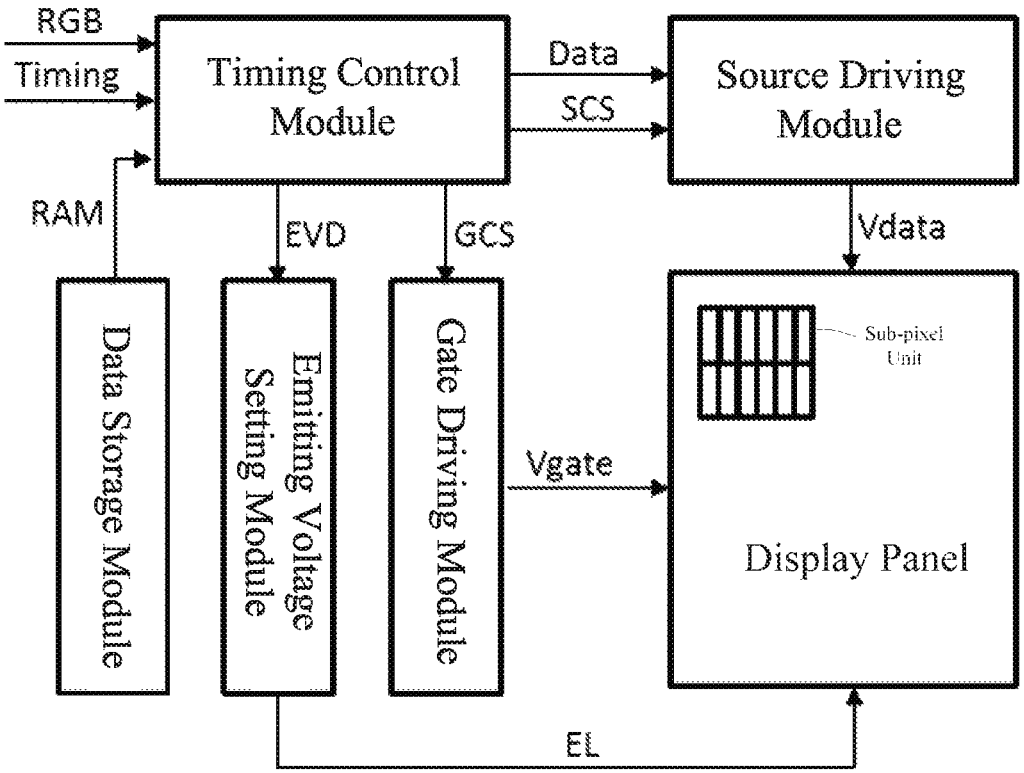
FIG. 4 is a structural schematic diagram illustrating a pixel driving device according to an embodiment of the present disclosure.
Figure 5:
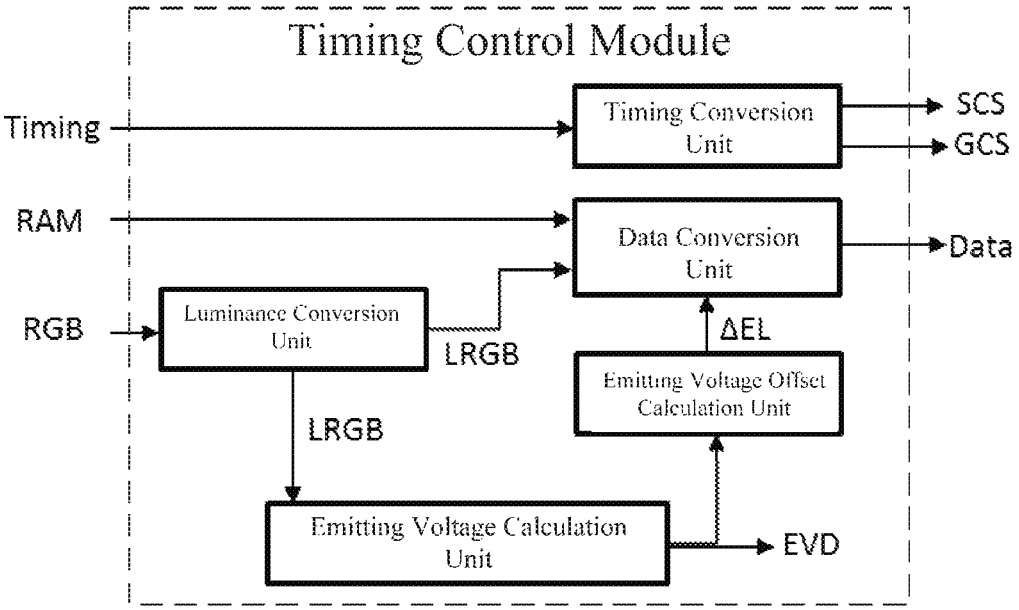
FIG. 5 is a structural schematic diagram illustrating a timing control module according to an embodiment of the present disclosure.
Figure 6:
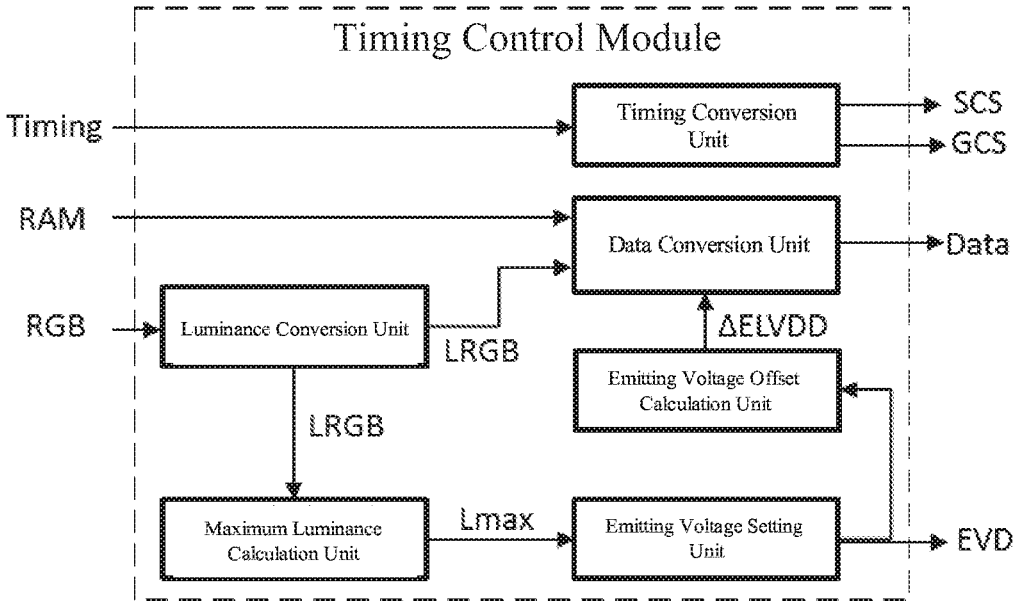
FIG. 6 is a structural schematic diagram illustrating a timing control module according to an embodiment of the present disclosure.
Figure 7:
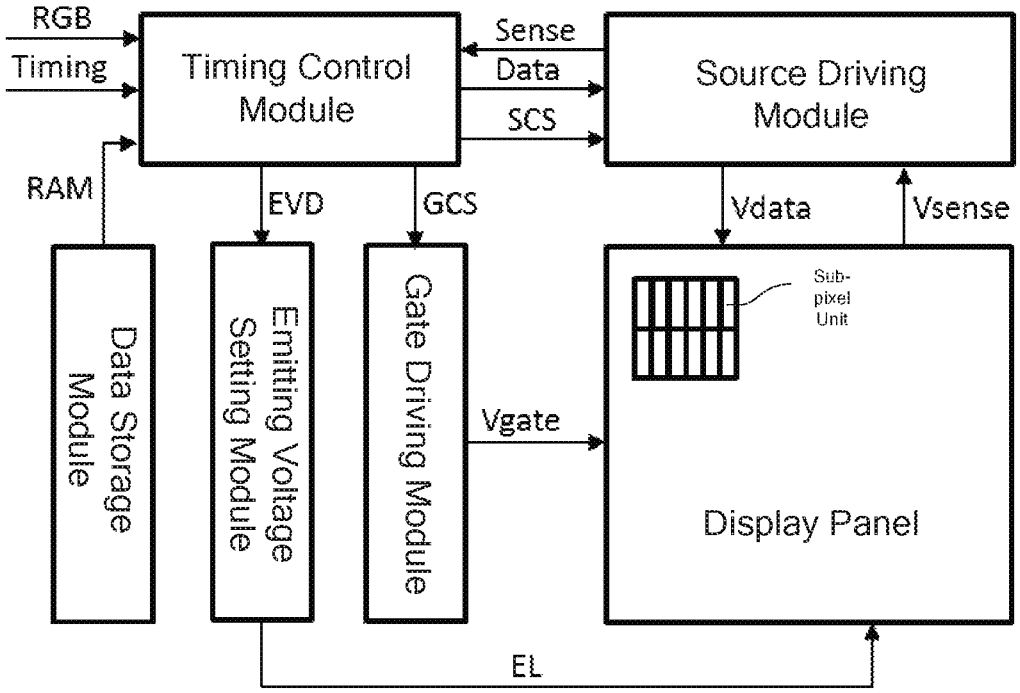
FIG. 7 is a structural schematic diagram illustrating a pixel driving device according to an embodiment of the present disclosure.
Figure 8:
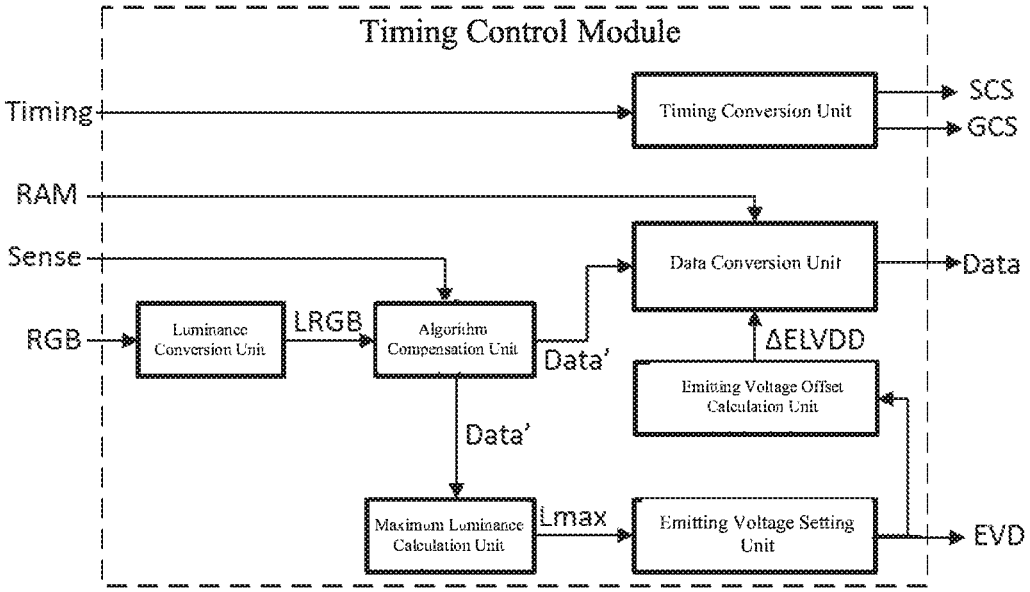
FIG. 8 is a structural schematic diagram illustrating a timing control module in the pixel driving device of FIG. 7.

Next, various embodiments of the present disclosure will be described in detail with reference to FIGS. 4 to 8. FIG. 4 is a structural schematic diagram illustrating a pixel driving device according to an embodiment of the present disclosure; FIG. 5 is a structural schematic diagram illustrating a timing control module according to an embodiment of the present disclosure; FIG. 6 is a structural schematic diagram illustrating a timing control module according to an embodiment of the present disclosure; FIG. 7 is a structural schematic diagram illustrating a pixel driving device according to an embodiment of the present disclosure; and FIG. 8 is a structural schematic diagram illustrating a timing control module in the pixel driving device of FIG. 7.

In some embodiments, the light emitting element may be equipped with a sensing and monitoring module to obtain real-time sensing data from the light emitting element. With reference to FIG. 8, in the presence of the sensing and monitoring module, the pixel compensation device in some embodiments may further include an algorithm compensation unit configured to receive the luminance signal data. LRGB and monitoring data Sense fed back from the source driving module and calculate compensated luminance data Data'. In this case, the emitting voltage calculation unit includes a compensation calculation sub-unit configured to calculate the preset emitting voltage data EVD based on the compensated luminance data Data' and transmit the preset emitting voltage data EVD to the emitting voltage offset calculation unit; and the data conversion unit includes a compensation conversion sub-unit configured to obtain corresponding second luminance compensation data based on the emitting voltage offset ΔEL and the emitting voltage offset compensation data, generate the source luminance data Data based on the compensated luminance data Data' and the second luminance compensation data, and output the source luminance data Data to the source driving module.

Here, the algorithm compensation unit can calculate the compensated luminance data Data' based on the monitoring data Sense, which is fed back in a real-time manner, to adjust the source luminance data Data, such that the stability of the brightness of the light emitting element can be improved.

To facilitate the calculation of the preset emitting voltage data EVD, the emitting voltage calculation unit may first calculate the maximum luminance value Lmax corresponding to the color data RGB. As illustrated in FIGS. 6 and 8, the emitting voltage calculation unit in some embodiments may include a maximum luminance calculation unit configured to receive the luminance signal data LRGB, calculate the maximum luminance value Lmax of the sub-pixel unit, and output the maximum luminance value Lmax to an emitting voltage setting unit; and the emitting voltage setting unit configured to receive the maximum luminance value Lmax of the sub-pixel unit, generate the preset emitting voltage data EVD, and output the preset emitting voltage data EVD to the emitting voltage offset calculation unit.

According to the embodiments of the present disclosure, the complex data calculation process is divided into a plurality of steps and the respective units have their specific functions to avoid signal interference.

According to the above-described pixel compensation device, the present disclosure further provides a timing control module including the pixel compensation device.

Furthermore, as illustrated in FIGS. 4 to 8, the timing control module in some embodiments may further include a timing conversion unit configured to receive a timing control signal Timing and generate a source control signal SCS and a gate control signal GCS.

The present disclosure further provides a pixel driving device including the above-described timing control module.

As illustrated in FIGS. 4 and 7, the pixel driving device in some embodiments further includes: a data storage module RAM configured to pre-store the emitting voltage offset compensation data for a corresponding driving transistor with respect to a corresponding gate-source voltage to be read by the data conversion unit; a source driving module configured to receive the source luminance data Data and the source control signal SCS and generate a source driving voltage Vdata for the sub-pixel unit; a gate driving module configured to receive the gate control signal GCS and generate a gate driving voltage Vgate for the sub-pixel unit; and an emitting voltage setting module configured to receive the preset emitting voltage data EVD and generate the anode voltage ELVDD and/or the cathode voltage ELVSS for the light emitting element.

Next, the present disclosure will be described in more details with reference to the pixel driving device illustrated in FIG. 4 and the sub-pixel unit as illustrated in FIG. 1.

As illustrated in FIG. 1, the OLED serves as the ight emitting element, and when the driving transistor T1 operates in a saturation region, the difference in voltage between the source G and the gate S is fixed. In a case where $V_{DS}$ is changed, the current $I_{DS}$ from the drain D to the source S of the driving transistor T1 will be slightly changed. For example, if the anode voltage ELVDD for the light emitting element OLED decreases, then $I_{DS}$ decreases and the brightness of the light emitting element OLED slightly decreases, such that the display brightness of the display panel that uses the light emitting element OLED in a physical display sub-pixel is changed, thereby affecting the product quality and the user experience. In the embodiments of the present disclosure, information such as anode voltages ELVDD and corresponding values of $I_{DS}$ for a plurality of or all types of OLEDs may be stored in advance in the data storage module. For example, specific values of $V_{DS}$ corresponding to specific values of $I_{DS}$ with respect to a plurality of specific values of the gate-source voltage $V_{GS}$ of the driving transistor(s) T1, and luminance compensation data corresponding to specific combinations of values of $V_{GS}$, $I_{DS}$ and $V_{DS}$ are stored in the data storage module; or specific values of $I_{DS}$ and specific values of $V_{DS}$ corresponding to specific gate voltages $V_G$, source voltages $V_S$ and drain voltages $V_D$ are stored in the data storage module. in a case where the driving transistor operates under a specific $V_{GS}$ and $I_{DS}$, when the value of the anode voltage ELVDD decreases from a first value to a second value, the luminance value of the light emitting element corresponding to $V_{DS}$ corresponding to the first value, and the luminance value of the light emitting element corresponding to $V_{DS}$ corresponding to the second value under the specific $V_{GS}$ and $I_{DS}$ can be found to obtain the luminance compensation value required to compensate the light emitting element. The luminance compensation data includes luminance compensation values for various driving transistors with respect to various parameters. The luminance compensation value can be obtained by referring to the luminance compensation data, and then the source luminance data Data of the driving transistor T1 is adjusted such that the brightness that is supposed to be decreased can be compensated for, thereby keeping the brightness of the OLED unchanged. As such, in the present disclosure, the data storage module configured to pre-store emitting voltage offset compensation data for each driving transistor with respect to different gate-source voltages $V_{GS}$ is provided in advance. When different driving transistors are selected and used, by searching in the data storage module, the performance parameters of the currently selected driving transistors and the emitting voltage offset compensation data with respect to corresponding values of $V_{GS}$ can be obtained.

As illustrated in FIG. 4, in some embodiments, the timing control module reads the pre-stored emitting voltage offset compensation data from the data storage module, generates the preset emitting voltage data EVD for the sub-pixel unit based on the color data RGB from external input, compares the preset emitting voltage data EVD with the reference value of the anode voltage ELVDD or the reference value of the cathode voltage ELVSS to obtain the emitting voltage offset ΔEL, and obtains the emitting voltage offset compensation data corresponding to the emitting voltage offset ΔEL based on the pre-stored emitting voltage offset compensation data for a corresponding OLED device with respect to a corresponding gate-source voltage. The source luminance data Data not only depends on the emitting data offset compensation data, but also depends on the color data RGB from external input. As such, the timing control module provided by the present disclosure generates the source luminance data Data based on the emitting voltage offset compensation data and the color data RGB from external input and outputs the source luminance data Data to the source driving module.

In some embodiments, the timing control module generates the preset emitting voltage data EVD and then transmits the preset emitting voltage data EVD to the emitting voltage setting module. The emitting voltage setting module generates the anode voltage ELVDD and the cathode voltage ELVSS matching the light emitting element OLED, alternatively, the emitting voltage setting module generates one of the anode voltage ELVDD and the cathode voltage ELVSS and keeps the other one as the reference value. The difference between the anode voltage ELVDD and the cathode voltage ELVSS affects the emission of the OLED, so the generated voltage may be the anode voltage ELVDD, or the cathode voltage ELVSS, or both. Obviously, the timing control module also generates the source control signal SCS and the gate control signal GCS based on the inputted timing control signal Timing, to control the source driving module and the gate driving module.

The source driving module generates the source driving voltage Vdata for the sub-pixel unit based on the source luminance data Data and the source control signal SCS and outputs the source driving voltage Vdata to the sub-pixel unit or the display panel. Here, the signal SCS is mainly configured to control the timing of the source driving module, for example, the timing of outputting the source luminance data Data. The gate driving module generates the gate driving voltage Vgate for the sub-pixel unit based on the gate control signal GCS and outputs the gate driving voltage Vgate to the sub-pixel unit or the display panel.

The present disclosure further provides a timing control module suitable for the pixel driving device of FIG. 4. As illustrated in FIG. 5, the timing control module in some embodiments may include: a luminance conversion unit configured to receive color data RGB for a sub-pixel unit, convert the color data RGB into corresponding luminance signal data LRGB, and output the luminance signal data LRGB to an emitting voltage calculation unit and a data conversion unit; the emitting voltage calculation unit configured to calculate preset emitting voltage data EVD for the sub-pixel unit based on the luminance signal data LRGB and output the preset emitting voltage data EVD to an emitting voltage offset calculation unit and an emitting voltage setting module; the emitting voltage offset calculation unit configured to receive the preset emitting voltage data EVD, compare the preset emitting voltage data EVD with a reference value of an anode voltage and/or a reference value of a cathode voltage for the sub-pixel unit to generate an emitting voltage offset ΔEL, and output the emitting voltage offset ΔEL to the data conversion unit; the data conversion unit configured to read from a data storage module emitting voltage offset compensation data for a corresponding driving transistor with respect to a corresponding gate-source voltage $V_{GS}$. calculate corresponding first luminance compensation data based on the emitting voltage offset ΔEL, generate source luminance data Data based on the luminance signal data LRGB and the first luminance compensation data and output the source luminance data Data to a source driving module.

Here, the emitting voltage calculation unit receives the luminance signal data LRGB, calculates the maximum luminance value Lmax of one or more rows of sub-pixels or one or more frames of sub-pixel images, and based on the maximum luminance value Lmax, calculates the anode voltage ELVDD or the cathode voltage ELVSS most suitable for the one or more rows of sub-pixels or the one or more frames of sub-pixel images or calculates both values of the anode voltage ELVDD and the cathode voltage ELVSS. Then, the emitting voltage calculation unit generates the preset emitting voltage data EVD for changing the anode voltage ELVDD or the cathode voltage ELVSS and outputs the preset emitting voltage data EVD to the emitting voltage offset calculation unit and the emitting voltage setting module.

In some embodiments, the data conversion unit may store luminance signal data LRGB for one or more rows of sub-pixels or one or more frames of sub-pixel images; then, the data conversion unit reads from the data storage module the pre-stored emitting voltage offset compensation data for a corresponding driving transistor with respect to a corresponding gate-source voltage, and the data conversion unit further determines the luminance compensation data corresponding to different OLED devices with respect to respective gate-source voltages, based on the emitting voltage offset ΔEL output from the emitting voltage offset calculation unit; after that, the data conversion unit finds corresponding emitting voltage offset compensation data from the luminance compensation data based on values of different input luminance signal data LRGB; and finally, the data conversion unit calculates the source luminance data Data based on the luminance signal data LRGB and the emitting voltage offset compensation data and outputs the source luminance data Data to the source driving module.

In the embodiment as illustrated in FIG. 6, a case where only the anode voltage ELVDD is to be changed is taken as an example, so the emitting voltage offset calculation unit only outputs a change amount ΔELVDD of the anode voltage; in other embodiments, ΔEL may also refer to a change amount ΔELVSS of the cathode voltage. Alternatively, both of the anode voltage and the cathode voltage may be changed, and the change amount ΔELVDD of the anode voltage and the change amount ΔELVSS of the cathode voltage may be calculated simultaneously. Next, the operating procedure of the data conversion unit will be described by taking an example in which only the anode voltage ELVDD is changed. The procedure includes the following steps 1 to 4.

At step 1, an $I_{DS}$-$V_{DS}$ curve for a corresponding driving transistor with respect to a corresponding gate-source voltage is read from the data storage module, the data storage module stores $I_{DS}$-$V_{DS}$ curves of each driving transistor with respect to different gate-source voltages $V_{GS}$ and corresponding emitting voltage offset compensation data.

At step 2, the emitting voltage offset ΔEL between the anode voltage ELVDD and a reference value of the anode voltage ELVDD that is output from the emitting voltage offset calculation unit is read or calculated.

At step 3, the required first luminance compensation data ΔLRGB is calculated based on the pre-stored emitting voltage offset compensation data, the emitting voltage offset ΔEL and the luminance signal data LRGB. Assuming that LRGBi is a luminance signal data for a sub-pixel, IRGBi is a corresponding current flowing through a driving transistor, Vgsi is a corresponding gate-source voltage of the driving transistor, ΔIRGBi is a compensation driving current corresponding to ΔEL, and ΔLRGBi is the first luminance compensation data for LRGBi, then IRGBi=LUT 1(LRGBi), Vgsi=LUT2(IRGBi), ΔIRGBi=LUT3(Vgsi, ΔEL), ΔLRGBi=LUT4(ΔIRGBi), where LUT1, LUT2, LUT3 and LUT4 represent different preset mapping functions, respectively.

At step 4, the compensated data is determined by adding the first luminance compensation data LRGBi with the original luminance signal data LRGBi to obtain the corresponding source luminance data Datai, that is: Datai=LRGBi+ΔLRGBi.

From the above description of the compensation algorithm it can be seen that the reduction of the brightness of the light emitting element caused by the change of the anode voltage ELVDD can be compensated for by the compensated source luminance data Datai.

Similar steps can be applied to the case where the emitting voltage offset ΔEL is a comparison result between the cathode voltage ELVSS and the reference value of the cathode voltage ELVSS.

In the above embodiments, the timing control module may further include a timing conversion module configured to receive the timing control signal Timing and generate the source control signal SCS and the gate control signal GCS.

The $I_{DS}$-$V_{DS}$ characteristic curves of driving transistors having different performance parameters with respect to different gate-source voltages may be measured and stored before shipment of the display panels. The characteristic curves may be different among different display panels, and the driving transistors for different sub-pixel units within each display panel may also have different characteristic curves. For this reason, the data storage module may also store other data, for example, characteristic values of various driving transistors such as threshold voltages Vth and mobility K, Characteristic values of various light emitting elements such as threshold voltages Vth_oled of OLED devices and optical compensation characteristic values, and other characteristic values of various driving transistors and various light emitting elements (e.g., OLED devices). All of these characteristic values may be stored or one or more of these characteristic values may be stored. The data storage module may include high-speed random access memory RAM, non-volatile memories, for example, at least one of magnetic storage devices, flash memory, or other volatile solid-state storage devices. The emitting voltage offset compensation data may be stored in a non-volatile memory ROM, and when in use, the emitting voltage offset compensation data is first read into a high-speed random access memory RAM and then read by the timing control module from the RAM.

According to the pixel driving device in the above embodiments, the present disclosure provides a sub-pixel unit. As illustrated in FIG. 1, the sub-pixel unit in some embodiments includes at least one light emitting element. The cathode of the light emitting element is applied with the cathode voltage ELVSS, and the anode of the light emitting element is coupled with the source of the driving transistor T1. The drain of the driving transistor T1 is applied with the anode voltage ELVDD for the light emitting element, and the gate of the driving transistor T1 is coupled with a drain of a switching transistor T2. A gate of the switching transistor T2 is coupled with a scan line GL and a source of the switching transistor T2 is coupled with a data line DL. The storage capacitor Cst is connected between the drain of the switching transistor T2 and the source of the driving transistor T1.

The gate of the switching transistor T2 is controlled by the gate control signal GCS through the scan line GL, The source driving voltage Vdata is generated from the source luminance data Data by the source driving module, input to the source of the switching transistor T2 of the sub-pixel unit through the data line DL, and further input to the gate of the driving transistor T1. The source control signal SCS is mainly configured to control the timing of the source driving module, for example, the timing of outputting the source luminance data Data and the like. Operating values of the anode voltage ELVDD and the cathode voltage ELVSS are set by the emitting voltage setting module. The present sub-pixel unit has a simple circuit structure and costs less to improve.

To improve display accuracy of the sub-pixel unit, especially to solve problems due to aging of the driving transistor, the present disclosure further provides an implementation of another pixel driving device. As illustrated in FIG. 7, the sub-pixel unit in some embodiments further includes a sensing and monitoring module configured to detect sensing and monitoring data V sense that is fed back from the sub-pixel unit. The sensing and monitoring module outputs the sensing and monitoring data Vsense to the timing control module through the source driving module. The timing control module may adjust the source luminance data Data in a real-time manner based on the received monitoring data Sense, so as to maintain the uniformity of the brightness.

In the present embodiment, the timing control module reads the data stored in the data storage module while receiving the color data RGB from external input, the monitoring data Sense output from the source driving module and the timing control signal Timing. By way of calculation, data conversion, compensation and other algorithms, the timing control module generates source luminance data Data and source control signal SCS and outputs the same to the source driving module, generates the gate control signal GCS and outputs the same to the gate driving module, and generates the preset emitting voltage data EVD and outputs the same to the emitting voltage setting module.

The data storage module stores the emitting voltage offset compensation data of various OLED devices with respect to different gate-source voltage. Moreover, the data storage module may store characteristic values of various driving transistors such as threshold voltages Vth and mobility K, characteristic values of various OLED devices such as threshold voltages Vth_oled, characteristic values of various driving transistors, and optical compensation characteristic values of various OLED devices.

The source driving module receives the source luminance data Data and the source control signal SCS, generates the source driving voltage Vdata, and outputs the source driving voltage Vdata to the display panel. Under the control of the source control signal SCS, the source driving module senses characteristic values of all or some of driving transistors or light emitting elements (i.e., OLED in drawings) in a row, generates the monitoring data Sense by analog-to-digital conversion, and outputs the monitoring data Sense to the timing control module.

The gate driving module receives the gate control signal GCS, generates the gate driving voltage Vgate, and outputs the gate driving voltage Vgate to the display panel. The emitting voltage setting module receives the preset emitting voltage data EVD, generates an optimal EL voltage for one or more rows of sub-pixels or one or more frames of sub-pixel images and outputs the optimal EL voltage to the display panel. The EL voltage may be the anode voltage ELVDD for the OLED device or the cathode voltage ELVSS for the OLED device.

Based on the embodiment illustrated in FIG. 7, the present disclosure further provides a timing control module suitable for the embodiment. As illustrated in FIG. 8, the timing control module in some embodiments includes: a luminance conversion unit configured to receive color data RGB for a sub-pixel unit, convert the color data RGB into corresponding luminance signal data LRGB, and output the lumincance signal data LRG-B to an algorithm compensation unit; the algorithm compensation unit configured to receive the luminance signal data LRGB and monitoring data Sense fed back from the source driving module, calculate compensated luminance data Data' based on the luminance signal data. LRGB and monitoring data Sense fed back from the source driving module, and output the compensated luminance data Data' to an emitting voltage calculation unit and a data conversion unit; the emitting voltage calculation unit configured to receive the compensated luminance data Data', calculate a preset emitting voltage data EVD for the sub-pixel unit, and output the preset emitting voltage data EVD to an emitting voltage offset calculation unit and an emitting voltage setting module; the emitting voltage offset calculation unit configured to receive the preset emitting voltage data EVD, compare the preset emitting voltage data EVD with a reference value of the anode voltage ELVDD or a reference value of the cathode voltage ELVSS to generate an emitting voltage offset ΔEL, and output the emitting voltage offset ΔEL to the data conversion unit (a case where only the anode voltage ELVDD is to be changed is taken as an example, so ΔEL is denoted as ΔELVDD in FIG. 8); and the data conversion unit configured to read pre-stored emitting voltage offset compensation data for a corresponding driving transistor with respect to a corresponding gate-source voltage, and obtain corresponding second luminance compensation data based on the emitting voltage offset ΔEL and the emitting voltage offset compensation data. The data conversion unit is further configured to generate source luminance data Data based on the compensated luminance data Data' and the second luminance compensation data, and output the source luminance data Data to the source driving module.

Here, the monitoring data Sense is input to the algorithm compensation unit of the timing control module from the source driving module. As illustrated in FIG. 8, the emitting voltage calculation unit in some embodiments may further include a maximum luminance calculation unit and an emitting voltage setting unit.

The maximum luminance calculation unit is configured to receive the luminance signal data LRGB, calculate the maximum luminance value Lmax for the sub-pixel unit, and output the maximum luminance value Lmax to the emitting voltage setting unit.

The emitting voltage setting unit is configured to receive the maximum luminance value Lmax, generate the preset emitting voltage data EVD, and output the preset emitting voltage data EVD to the emitting voltage setting module and the emitting voltage offset calculation unit.

The timing control module may further include a time conversion unit. The timing conversion unit receives an external timing control signal Timing, and generates the source control signal SCS for the source driving module and the gate control signal GCS for the gate driving module. The luminance conversion unit receives the external color data RGB, converts the color data RGB into luminance signal data LRGB, and outputs the luminance signal data LRGB to the algorithm compensation unit. The algorithm compensation unit receives the luminance signal data LRGB output from the luminance conversion unit and the monitoring data Sense output from the source driving module, and outputs the luminance data Data' subjected to algorithms and compensations to the data conversion unit and the maximum luminance calculation unit. The algorithms include a series of algorithms such as RBG-RGBW algorithm, peak luminance algorithm, complementary color algorithm, current control algorithm and the like. The compensations include compensation for characteristic value of the driving transistor, compensation for characteristic value of the OLED, optical compensation and the like.

The maximum luminance calculation unit receives the luminance data. Data', calculates the maximum luminance value Lmax of one or more rows of sub-pixels or one or more frames of sub-pixel images, and outputs the maximum luminance value Lmax to the emitting voltage setting unit. The emitting voltage setting unit receives the maximum luminance value Lmax of the one or more rows of sub-pixels or the one or more frames of sub-pixel images, calculates the optimal anode voltage ELVDD and/or optimal cathode voltage ELVSS most suitable for the one or more rows of sub-pixels or the one or more frames of sub-pixel images, generates the preset emitting voltage data EVD for changing the EL voltage signal, and outputs the preset emitting voltage data EVD to the emitting voltage offset calculation unit and the emitting light setting module simultaneously. The emitting voltage offset calculation unit receives the preset emitting voltage data EVD and compares the preset emitting voltage data EVD with a reference value of the anode voltage ELVDD and/or a reference value of the cathode voltage ELVSS to generate the emitting voltage offset ΔEL.

The data conversion unit may store the luminance data Data' for one or more rows of sub-pixels or one or more frames of sub-pixel images. The data conversion unit first read the pre-stored emitting voltage offset compensation data for a corresponding driving transistor with respect to a corresponding gate-source voltage. Then, the data conversion unit determines the compensation data for the source luminance data Data based on the value of ΔEL output from the emitting voltage offset calculation unit, i.e., determines the emitting voltage offset compensation data corresponding to the specific driving transistor, the actual value of the gate-source voltage and ΔEL. After that, the data conversion unit looks up compensation data corresponding to different input luminance data Data' in the compensation data based on the values of the different input luminance data Data'. Finally, the data conversion unit adds the luminance data Data' with the compensation data corresponding to the luminance data Data' to obtain the source luminance data Data and outputs the source luminance data Data.

According to the operating procedure of the data conversion unit, the final output value of the source luminance data Data in the embodiment illustrated in FIG. 7 can be calculated as follows:

$$\Delta Data' = LUT5(Data', \Delta EL),$$

$$Data = Data' + \Delta Data',$$

where LUT5 is another preset mapping function.

The sub-pixel unit in the above embodiments may include a driving transistor, a switching transistor and at least one light emitting element. A cathode of the light emitting element is applied with a cathode voltage, and an anode of the light emitting element is coupled with a source of the driving transistor. A drain of the driving transistor is applied with an anode voltage for the light emitting element, and a gate of the driving transistor is coupled with a drain of the switching transistor. A gate of the switching transistor is coupled with a first scan line, and a source of the switching transistor is coupled with a data line. A storage capacitor is connected between the drain of the switching transistor and the source of the driving transistor. The sub-pixel unit may further include a sensing and monitoring module. The sensing and monitoring module includes a sensing transistor having a drain coupled with a sensing line, a source coupled with the source of the driving transistor, and a gate coupled with a second scan line.

The gate of the switching transistor is controlled by a gate control signal through the first scan line. A source driving voltage is generated from the source luminance data by the source driving module, input to the source of the switching transistor of the sub-pixel unit through the data line, and further input to the gate of the driving transistor. The source control signal is mainly configured to control the timing of the source driving module, for example, the timing of outputting the source luminance data Data and the like. The sensing state of the sensing transistor is controlled by a timing signal through the second scan line.

Figure 9:
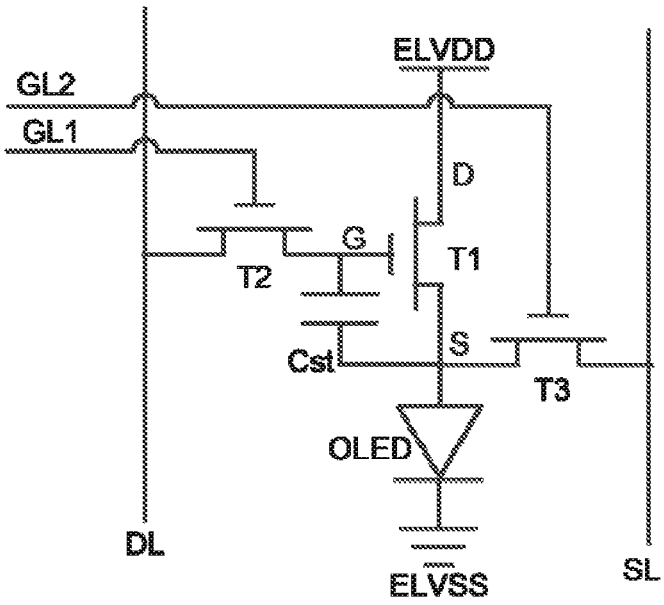
FIG. 9 is a structural schematic diagram illustrating a sub-pixel circuit according to an embodiment of the present disclosure.

FIG. 9 is a structural diagram illustrating a sub-pixel circuit according to an embodiment of the present disclosure. As illustrated in FIG. 9, in some embodiments, the sub-pixel circuit includes a driving transistor T1, a switching transistor T2 and at least one light emitting element (OILED in the drawing serves as the light emitting element). A cathode of the light emitting element is applied with a cathode voltage ELVSS and an anode of the light emitting element is coupled with a source node S) of the driving transistor T1. A drain (i.e., node D) of the driving transistor T1 is applied with an anode voltage ELVDD for the light emitting element, and a gate (i.e., node G) of the driving transistor T1 is coupled with a drain of the switching transistor T2. A gate of the switching transistor T2 is coupled with a first scan line GL1, and a source of the switching transistor T2 is coupled with a data line DL. A storage capacitor Cst is connected between the drain of the switching transistor T2 and the source of the driving transistor T1. The sub-pixel circuit may further include a sensing and monitoring module configured to detect sensing and monitoring data Vsense for the light emitting element, and feed back the sensing and monitoring data Vsense to the timing control module.

The anode voltage ELVDD and the cathode voltage ELVSS for the sub-pixel circuit may be adjusted to the optimal operating voltages by the emitting voltage setting module, and the compensated source driving voltage Vdata may be output through the data line DL, such that the stability of the brightness of the OLED can be ensured. The sub-pixel circuit can be used in combination with the above-described embodiments or can be used independently.

Based on the sub-pixel circuit, the present disclosure further provides a specific circuit structure capable of monitoring characteristic values of the driving transistor or OLED device of the sub-pixel circuit, to further improve the stability of the brightness of the OLED. in this circuit structure, the sensing and monitoring module includes a sensing transistor T3. A source of the sensing transistor T3 is coupled with the source of the driving transistor T1, a gate of the sensing transistor T3 is coupled with a second scan line GL2, and a drain of the sensing transistor T3 is coupled with a sensing line SL, so that the sensing and monitoring data can be output to the timing control module through the sensing line SL.

Driving transistors T1 for different sub-pixels may have different characteristic values, causing that the sensing and monitoring data Vsense sensed by the sensing line SL may be different. By feeding back the sensing and monitoring data Vsense in a real-time manner, the change of characteristic value of the driving transistor T1 can be calculated, thereby the abnormity of driving current due to problems of the driving transistor T1 such as aging can be compensated for.

Figure 10:
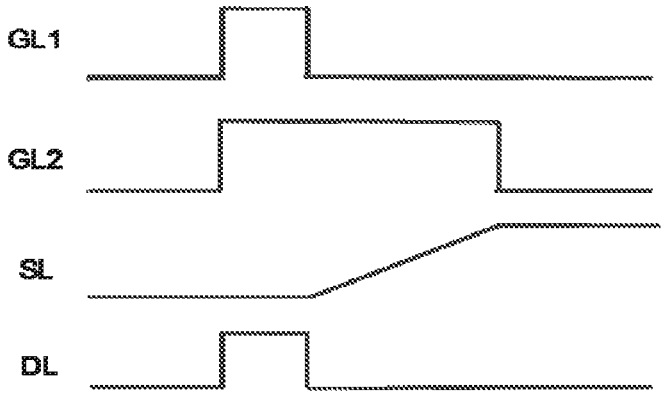
FIG. 10 is a timing diagram of a source driving module and a gate driving module according to an embodiment of the present disclosure.

FIG. 10 is a timing diagram of the source driving module and the gate driving module according to an embodiment of the present disclosure. The operating procedure of the sub-pixel unit will be explained with reference to FIGS. 9 and 10. In a blank frame of an image, the voltage levels of the first scan line GU. and the second scan line GL1 are changed to a high level to turn on the switching transistor T2 and the sensing transistor T3. At this time, the voltage at the anode of the OLED is reset by the sensing line SL, while the source driving voltage Vdata is written into the gate of the driving transistor T1 through the data line DL. Then, the voltage level of the first scan line GL I is changed to a low level, and the switching transistor T2 is turned off; the voltage level of the second scan line GL2 remains at the high level, and the sensing transistor T3 keeps on; and the sensing line SL is changed to a floating state. At this time, a current is flowing through the driving transistor T1, the voltage level of the sensing line SL increases, and a final voltage level of the sensing line SL may be detected after a certain time period. Parameters related to the emission of the OLED can be compensated for more accurately with reference to the final voltage level and other data.

For example, with respect to a same driving voltage, the final voltage levels sensed by the sensing line may be different due to different characteristic values of driving transistors for different sub-pixels. By having the final voltage level, the change of the characteristic value of the driving transistor T1 can be calculated, thereby slight change of the driving transistor T1 due to aging thereof can be compensated for to improve the display accuracy.

Based on the implementations of the pixel driving devices, the present disclosure further provides a display apparatus, which includes any one of the pixel driving devices. The display apparatus may be a semi-finished product such as a display panel assembly or a finished product such as a mobile phone, a television and various electric appliances having a display screen.

Based on the above-described sub-pixel circuits, the present disclosure further provides an array substrate, which includes a base substrate and a plurality of sub-pixel circuits provided on the base substrate.

Based on above-described the array substrate, the present disclosure further provides a display apparatus including the array substrate.

Based on the above-described pixel driving devices, the present disclosure further provides a pixel compensation method. In some mbodiments, the method includes: reading pre-stored emitting voltage offset compensation data for a corresponding driving transistor with respect to a corresponding gate-source voltage; receiving color data RGB for a sub-pixel unit and converting the color data RGB into corresponding luminance signal data LRGB; calculating preset emitting voltage data EVD for the sub-pixel unit based on the luminance signal data; comparing the preset emitting voltage data with a reference value of an anode voltage and/or a reference value of a cathode voltage for the sub-pixel unit to generate an emitting voltage offset; obtaining corresponding first luminance compensation data based on the emitting voltage offset and the emitting voltage offset compensation data; and generating source luminance data based on the luminance signal data LRGB and the first luminance compensation data and outputting the source luminance data to a source driving module.

Either the reference value of the anode voltage or the reference value of the cathode voltage may be compared with the preset emitting voltage data to generate the emitting voltage offset. Alternatively, both of the reference values may be respectively compared with the preset emitting voltage data to generate the respective emitting voltage offsets.

Figure 11:
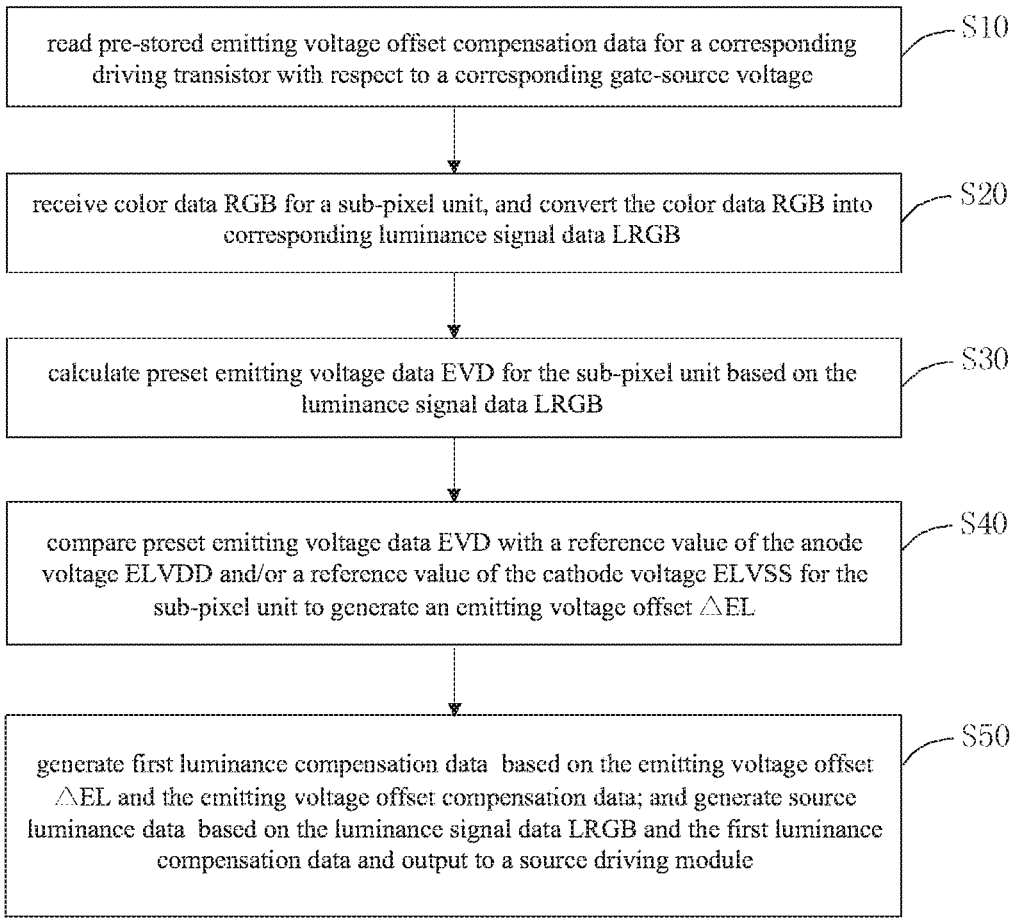
FIG. 11 is a flow chart illustrating a pixel compensation method according to an embodiment of the present disclosure.

FIG. 11 is a flow chart illustrating a pixel compensation method according to an embodiment of the present disclosure. As illustrated in FIG. 11, the method in some embodiments may include steps S10 to S50.

At step S10, pre-stored emitting voltage offset compensation data for a corresponding driving transistor with respect to a corresponding gate-source voltage is read.

Referring to FIGS. 1 and 4, the emitting voltage offset compensation data for the driving transistor with respect to specific gate-source voltages may be pre-stored in the data storage module. According to actual needs, the data storage module may store emitting voltage offset compensation data for all driving transistors possibly used, or store emitting voltage offset compensation data for a specific driving transistor. Moreover, the data storage module may also store one or more of: characteristic values of different driving transistors, characteristic values of different light emitting elements, optical compensation characteristic values of different light emitting elements, such that more features can be extended as required.

At step S20, color data RGB for a sub-pixel unit is received, and the color data RGB is converted into corresponding luminance signal data LRGB.

The color data RGB is preset sub-pixel display data of an linage to be displayed. The color data RGB is converted into luminance signal data LRGB to calculate preset emitting voltage data EVD for each sub-pixel unit.

At step S30, the preset emitting voltage data EVD for the sub-pixel unit is calculated based on the luminance signal data LRGB.

The preset emitting voltage data EVD can change, through the emitting voltage setting module, any one or both of the anode voltage ELVDD for the light emitting element and the cathode voltage for the light emitting element, to lower electroluminescence consumption.

At step S40, the preset emitting voltage data EVD is compared with a reference value of the anode voltage ELVDD and/or a reference value of the cathode voltage ELVSS for the sub-pixel unit to generate an emitting voltage offset ΔEL.

The preset emitting voltage data EVD is the emitting voltage data suitable for LRGB. When ELVDD or ELVSS constantly changes based on display images, a reference value is required for reference purpose. The reference value is the reference value of the anode voltage ELVDD or the cathode voltage ELVSS, the specific value of which may take an empirical value.

At step S50, first luminance compensation data is obtained based on the emitting voltage offset ΔEL and the emitting voltage offset compensation data; source luminance data is generated based on the luminance signal data LRGB and the first luminance compensation data and output to a source driving module.

For obtaining the first luminance compensation data at step S50, it is required to read a group of emitting voltage offset compensation data for a corresponding OLED device with respect to a corresponding gate-source voltage and look up data corresponding to the emitting voltage offset ΔEL in the group of emitting voltage offset compensation data. After that, the first luminance compensation data ΔLRGB that is required for keeping the brightness of the OLED device unchanged is calculated and added to the original luminance signal data LRGB to obtain the source luminance data Data, which is further converted into the source driving voltage Vdata by the source driving module.

According to the method provided by the present disclosure, the preset emitting voltage data EVD for the sub-pixel unit is first calculated, then the first luminance compensation data is calculated based on the difference between the preset emitting voltage data EVD and the reference voltage value(s), and finally the source luminance data is adjusted to keep the brightness of the light emitting element in the sub-pixel unit unchanged, thereby achieving the purpose of lowering the EL consumption while keeping the brightness of the light emitting element unchanged.

To further improve the display quality, the present disclosure further provides a sub-pixel compensation method by monitoring a characteristic value of a driving transistor or light emitting element of a sub-pixel, based on the above method. In some embodiments, after the color data RGB is converted into corresponding luminance signal data LRGB, the method further includes: calculating compensated luminance data Data' based on the luminance signal data LRGB and monitoring data Sense fed back from the source driving module. Calculating preset emitting voltage data EVD for the sub-pixel unit based on the luminance signal data LRGB includes: calculating the preset emitting voltage data EVD for the sub-pixel unit based on the compensated luminance data Data'. Obtaining the first luminance compensation data ΔLRGB based on the emitting voltage offset ΔEL and the emitting voltage offset compensation data; and generating the source luminance data Data based on the luminance signal data LRGB and the first luminance compensation data ΔLRGB include: obtaining second luminance compensation data based on the emitting voltage offset ΔEL and the emitting voltage offset compensation data, and generating the source luminance data Data based on the compensated luminance data Data' and the second luminance compensation data.

According to the present embodiment, before calculating the emitting voltage data EVD, the sensing and monitoring data Vsense fed back from the sub-pixel unit is received to sense the characteristic value of the driving transistor or OLED device of the sub-pixel in a real-time manner, such that the source luminance data Data can be adjusted in a real-time manner. As such, the problem related to the change of driving current due to aging of the driving transistor can be improved, so as to further improve the display quality of the sub-pixels.

Portions of the present disclosure may be implemented in hardware, software, firmware, or a combination thereof. In the above embodiments, a plurality of steps or methods may be implemented using software or firmware stored in a memory and executed by a suitable instruction execution system. For example, if implemented in hardware, as in another embodiment, it can be implemented using any one or a combination of e following techniques known in the art: discrete logic circuit having logic gate circuits for implementing logic functions on data signals, Central Processing Units (CPUs), Digital Processors (DSPs), Application Specific Integrated Circuits (ASICs), Programmable Gate Arrays (PGAs), Field Programmable Gate Arrays (FPGAs), etc. with suitable combinational logic gate circuits.

In addition, each functional unit in each embodiment of the present disclosure may be integrated in one processing module, or each unit may exist alone physically, or two or more units may be integrated in one module. The above integrated module can be implemented in the form of hardware or in the form of a software function module. The integrated module can also be stored in a computer readable storage medium if it is implemented in the form of a software functional module and sold or used as an independent product.

In the description of the present specification, the description referring to the terms "one embodiment", "some embodiments", "an example". "a specific example", "some examples" or the like means specific features, structures, materials, or features described in conjunction with the embodiment or example are included in at least one embodiment or example of the present disclosure. In this specification, the schematic representation of the above terms does not necessarily have to refer to the same embodiment or example. Furthermore, the particular features, structures, materials, or characteristics described may be combined in any suitable manner in any one or more of the embodiments or examples. In addition, those skilled in the art may combine and incorporate different embodiments or examples and features thereof described in this specification without conflicting with each other.

Furthermore, the terms "first" and "second" are used for descriptive purposes only, and are not to be construed as indicating or implying relative importance or implicitly indicating the number of indicated technical features. Thus, features defined as "first", "second" may explicitly or implicitly include at least one such feature. In the description of the present disclosure, the meaning of "plurality" is at least two, such as two, three, etc., unless specifically defined otherwise.

The terminology used herein is for the purpose of describing particular embodiments only and is not intended to be limiting of example embodiments. As used herein, the singular forms "a," "an," and "the" are intended to include the plural forms as well, unless the context clearly indicates otherwise. It will be further understood that the terms "comprises," "comprising," "includes," and/or "including," if used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by those of ordinary skill in the art to which the inventive concepts pertain. It will also be understood that terms, such as those defined in commonly used dictionaries, should be interpreted as having a meaning that is consistent with their meaning in the context of this specification and the relevant art and will not be interpreted in an idealized or overly formal sense unless expressly so defined herein.

When a certain example embodiment may be implemented differently, a specific process order may be performed differently from the described order. For example, two consecutively described processes may be performed substantially at the same time or performed in an order opposite to the described order.

As used herein, the tem "and/or" includes any and all combinations of one or more of the associated listed items. Expressions such as "at least one of," when preceding a list of elements, modify the entire list of elements and do not modify the individual elements of the list.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements or layers should be interpreted in a like fashion (e.g., "between" versus "directly between," "adjacent" versus "directly adjacent," "on" versus "directly on").

Like numbers refer to like elements throughout. Thus, the same or similar numbers may be described with reference to other drawings even if they are neither mentioned nor described in the corresponding drawing. Also, elements that are not denoted by reference numbers may be described with reference to other drawings.

While the inventive concepts have been particularly shown and described with reference to embodiments thereof, it will be understood that various changes in form and details may be made therein without departing from the spirit and scope of the following claims.

What is claimed is:

1. A pixel compensation device, comprising:

a luminance conversion unit configured to receive color data for a sub-pixel unit and convert the color data into corresponding luminance signal data;

an emitting voltage calculation unit configured to calculate preset emitting voltage data for the sub-pixel unit based on the luminance signal data;

an emitting voltage offset calculation unit configured to receive the preset emitting voltage data, compare the preset emitting voltage data with a reference value of an anode voltage and/or a reference value of a cathode voltage for the sub-pixel unit to generate an emitting voltage offset; and a data conversion unit configured to read pre-stored emitting voltage offset compensation data for a driving transistor in the sub-pixel unit with respect to a gate-source voltage of the driving transistor and obtain corresponding first luminance compensation data based on the emitting voltage offset and the emitting voltage offset compensation data, and further configured to generate source luminance data based on the luminance signal data and the first luminance compensation data and output the source luminance data to a source driving module, wherein the preset emitting voltage data is used for generating a reduced anode voltage and/or a reduced cathode voltage for a light emitting element of the sub-pixel unit, thereby lowering power consumption of the light emitting element, and wherein the first luminance compensation data is used for compensating for a change in brightness of the light emitting element due to the reduced anode voltage and/or the reduced cathode voltage, thereby keeping the brightness of the light emitting element unchanged, wherein the data conversion unit is configured to obtain the first luminance compensation data based on following equations:

$IRGBi=LUT1(LRGBi)$, $Vgsi=LUT2(IRGBi)$, $\Delta IRGBi=LUT3(Vgsi, \Delta EL)$, and $\Delta LRGBi=LUT4(\Delta IRGBi)$, where LUT1, LUT2, LUT3 and LUT4 represent different preset mapping functions, respectively, LRGBi is the luminance signal data, IRGBi is a corresponding current flowing through the driving transistor, Vgsi is the gate-source voltage of the driving transistor, ΔEL is the emitting voltage offset, ΔIRGBi is a compensation driving current corresponding to ΔEL, and ΔLRGBi is the first luminance compensation data for LRGBi.

2. The pixel compensation device of claim 1, further comprising:

an algorithm compensation unit configured to receive monitoring data fed back from the source driving module and the luminance signal data and calculate compensated luminance data, wherein the emitting voltage calculation unit comprises a compensation calculation sub-unit configured to calculate the preset emitting voltage data for the sub-pixel unit based on the compensated luminance data and transmit the preset emitting voltage data to the emitting voltage offset calculation unit; and the data conversion unit comprises a compensation conversion sub-unit configured to obtain corresponding second luminance compensation data based on the emitting voltage offset and the emitting voltage offset compensation data and generate the source luminance data based on the compensated luminance data and the second luminance compensation data.

3. The pixel compensation device of claim 1, wherein the emitting voltage calculation unit comprises:

a maximum luminance calculation unit configured to calculate a maximum luminance value of the sub-pixel unit based on the luminance signal data and output the maximum luminance value to an emitting voltage setting unit; and the emitting voltage setting unit configured to receive the maximum luminance value of the sub-pixel unit, generate the preset emitting voltage data for the sub-pixel unit, and output the preset emitting voltage data to the emitting voltage offset calculation unit.

4. A timing control module, comprising the pixel compensation device of claim 1.

5. The timing control module of claim 4, wherein the pixel compensation device further comprises:

an algorithm compensation unit configured to receive monitoring data fed back from the source driving module and the luminance signal data and calculate compensated luminance data, wherein the emitting voltage calculation unit comprises a compensation calculation sub-unit configured to calculate the preset emitting voltage data for the sub-pixel unit based on the compensated luminance data and transmit the preset emitting voltage data to the emitting voltage offset calculation unit; and the data conversion unit comprises a compensation conversion sub-unit configured to obtain corresponding second luminance compensation data based on the emitting voltage offset and the emitting voltage offset compensation data and generate the source luminance data based on the compensated luminance data and the second luminance compensation data.

6. The timing control module of claim 4, wherein the emitting voltage calculation unit comprises:

a maximum luminance calculation unit configured to calculate a maximum luminance value of the sub-pixel unit based on the luminance signal data and output the maximum luminance value to an emitting voltage setting unit; and the emitting voltage setting unit configured to receive the maximum luminance value of the sub-pixel unit, generate the preset emitting voltage data for the sub-pixel unit, and output the preset emitting voltage data to the emitting voltage offset calculation unit.

7. The timing control module of claim 4, further comprising:

a timing conversion unit configured to receive a timing control signal and generate a source control signal and a gate control signal.

8. A pixel driving device, comprising the timing control module of claim 4.

9. The pixel driving device of claim 8, wherein the pixel compensation module further comprises:

an algorithm compensation unit configured to receive monitoring data fed back from the source driving module and the luminance signal data and calculate compensated luminance data, wherein the emitting voltage calculation unit comprises a compensation calculation sub-unit configured to calculate the preset emitting voltage data for the sub-pixel unit based on the compensated luminance data and transmit the preset emitting voltage data to the emitting voltage offset calculation unit; and the data conversion unit comprises a compensation conversion sub-unit configured to obtain corresponding second luminance compensation data based on the emitting voltage offset and the emitting voltage offset compensation data and generate the source luminance data based on the compensated luminance data and the second luminance compensation data.

10. The pixel driving device of claim 8, wherein the emitting voltage calculation unit comprises:

a maximum luminance calculation unit configured to calculate a maximum luminance value of the sub-pixel unit based on the luminance signal data and output the maximum luminance value to an emitting voltage setting unit; and the emitting voltage setting unit configured to receive the maximum luminance value of the sub-pixel unit, generate the preset emitting voltage data for the sub-pixel unit, and output the preset emitting voltage data to the emitting voltage offset calculation unit.

11. The pixel driving device of claim 8, wherein the timing control module further comprises:

a timing conversion unit configured to receive a timing control signal and generate a source control signal and a gate control signal.

12. The pixel driving device of claim 8, further comprising:

a data storage module configured to pre-store a plurality of groups of emitting voltage offset compensation data for driving transistors with respect to different gate-source voltages to be read by the data conversion unit;

a source driving module configured to receive the source luminance data and a source control signal and generate a source driving voltage for the sub-pixel unit;

a gate driving module configured to receive a gate control signal and generate a gate driving voltage for the sub-pixel unit; and an emitting voltage setting module configured to receive the preset emitting voltage data and generate the anode voltage and/or the cathode voltage for the light emitting element of the sub-pixel unit.

13. The pixel driving device of claim 12, wherein the data storage module is configured to pre-store one or more of: characteristic values of different driving transistors, characteristic values of different light emitting elements and optical compensation characteristic values of different light emitting elements.

14. The pixel driving device of claim 12, further comprising a sensing and monitoring module configured to detect sensing and monitoring data that is fed back from the sub-pixel unit and output the sensing and monitoring data to the timing control module through the source driving module.

15. The pixel driving device of claim 14, wherein the sub-pixel unit comprises a driving transistor, a switching transistor and at least one light emitting element; a cathode of the light emitting element is applied with a cathode voltage, and an anode of the light emitting element is coupled with a source of the driving transistor; a drain of the driving transistor is applied with an anode voltage for the light emitting element, and a gate of the driving transistor is coupled with a drain of the switching transistor; a gate of the switching transistor is coupled with a first scan line, and a source of the switching transistor is coupled with a data line; and a storage capacitor is connected between the drain of the switching transistor and the source of the driving transistor.

16. The pixel driving device of claim 15, wherein the sub-pixel unit further comprises a sensing transistor, a drain of the sensing transistor is coupled with a sensing line, a source of the sensing transistor is coupled with the source of the driving transistor, and a gate of the sensing transistor is coupled with a second scan line.

17. A display apparatus, comprising the pixel driving device of claim 8.

18. A pixel compensation method, comprising:

reading pre-stored emitting voltage offset compensation data for a driving transistor in a sub-pixel unit with respect to a gate-source voltage of the driving transistor;

receiving color data for the sub-pixel unit and converting the color data into corresponding luminance signal data;

calculating preset emitting voltage data for the sub-pixel unit based on the luminance signal data;

comparing the preset emitting voltage data with a reference value of an anode voltage and/or a reference value of a cathode voltage for the sub-pixel unit to generate an emitting voltage offset;

obtaining corresponding first luminance compensation data based on the emitting voltage offset and the emitting voltage offset compensation data; and generating source luminance data based on the luminance signal data and the first luminance compensation data and outputting the source luminance data to a source driving module, wherein the preset emitting voltage data is used for generating a reduced anode voltage and/or a reduced cathode voltage for a light emitting element of the sub-pixel unit, thereby lowering power consumption of the light emitting element, and wherein the first luminance compensation data is used for compensating for a change in brightness of the light emitting element due to the reduced anode voltage and/or the reduced cathode voltage, thereby keeping the brightness of the light emitting element unchanged, wherein the first luminance compensation data is obtained based on following equations:

$IRGBi=LUT1(LRGBi)$, $Vgsi=LUT2(IRGBi)$, $\Delta IRGBi=LUT3(Vgsi, \Delta EL)$, and $\Delta LRGBi=LUT4(\Delta IRGBi)$, where LUT1, LUT2, LUT3 and LUT4 represent different preset mapping functions, respectively, LRGBi is the luminance signal data, IRGBi is a corresponding current flowing through the driving transistor, Vgsi is the gate-source voltage of the driving transistor, $\Delta EL$ is the emitting voltage offset, $\Delta IRGBi$ is a compensation driving current corresponding to ΔEL and ΔLRGBi is the first luminance compensation data for LRGBi.

19. The pixel compensation method of claim 18, wherein after converting the color data into the corresponding luminance signal data, the method further comprises:

calculating compensated luminance data based on monitoring data fed back from the source driving module and the luminance signal data;

calculating preset emitting voltage data for the sub-pixel unit based on the luminance signal data comprises:

calculating the preset emitting voltage data for the sub-pixel unit based on the compensated luminance data; and obtaining the first luminance compensation data based on the emitting voltage offset and the emitting voltage offset compensation data; and generating the source luminance data based on the luminance signal data and the first luminance compensation data comprise:

obtaining second luminance compensation data based on the emitting voltage offset and the emitting voltage offset compensation data; and generating the source luminance data based on the compensated luminance data and the second luminance compensation data.

* * * * *